US006065993A

United States Patent [19]

Lai et al.

[11] Patent Number: 6,065,993

[45] Date of Patent: May 23, 2000

[54] CABLE CONNECTOR ASSEMBLY

[75] Inventors: Chin-Te Lai, Tao-Yuan, Taiwan; Gordon Lok, Montebello, Calif.

[73] Assignee: Hon Hai Precision Ind. Co., Ltd., Taipei Hsien, Taiwan

[21] Appl. No.: 09/200,228

[22] Filed: Nov. 25, 1998

Related U.S. Application Data

[63] Continuation-in-part of application No. 08/979,046, Nov. 26, 1997, Pat. No. 6,024,597.

[51] Int. Cl.[7] ..... H01R 4/24; H01R 4/26; H01R 11/20

[52] U.S. Cl. ..... 439/402; 439/497

[58] Field of Search ..... 439/402, 403, 439/497, 189

[56] References Cited

U.S. PATENT DOCUMENTS 4,641,904 2/1987 Kosugi ..... 439/497

*Primary Examiner*—Lincoln Donovan
*Assistant Examiner*—Javaid Nasri
*Attorney, Agent, or Firm*—Wei Te Chung

[57] ABSTRACT

A method of preventing disorientation of an insulation displacement shunting bar with respect to a spacer in an electrical cable connector assembly. The shunting bar has a base plate defining a first end and a second end and a plurality of piercing lances. The piercing lances on each of two opposite sides of the base plate are distanced a given pitch with the set of piercing lances on one side being offset a half of the pitch with respect to the set of piercing lances on the other side along a length of the base plate. The spacer has a cavity for accommodating the base plate of the shunting bar and the cavity of the spacer has a length slightly larger than a general length of the shunting bar. The method includes disposing a plurality of mounting openings equally spaced lengthwise on the base plate of the shunting bar which are offset substantially one-fourth of the pitch, as measured along the length of the base plate, with respect to the piercing lances on one of the two sides of the base plate and forming at least two mounting posts within the cavity of the spacer at positions aligned with two of the plurality of mounting openings. A shunting bar having offset mounting openings to prevent its disorientation within the spacer is also disclosed.

16 Claims, 11 Drawing Sheets

CABLE CONNECTOR ASSEMBLY

This application is a continuation-in-part application Ser. No. 08/979,046 filed Nov. 26, 1997 U.S. Pat. No. 6,024,597, issued Feb. 15, 2000.

BACKGROUND OF THE INVENTION

1. Field of The Invention

The invention relates to connector assembly, and particularly to the cable connector assembly using IDC (Insulative Displacement Contact) means for cooperation with an IDC like shunting bar for selectively connecting or shorting at least one set of specific contacts together.

2. The Related Art

Most I/O (Input/Output) cable connectors which, are generally different from the so-called flat cable connectors used on the interior of the computer, are used among the peripheries and computer, for example, U.S. Pat. No. 5,505,637. As well known, the cable connector contains a bunch of wires in the jacket of the cable and such I/O cable connector uses the traditional solder method to respectively solder the contacts to the corresponding wires. This soldering procedure takes time and labor, and costs money. Moreover, because the adjacent contacts are positioned close to each other, the solder may contaminate the adjacent contact/wire, thus resulting in the solder bridge between two adjacent contacts/wires and the corresponding undesired and incorrect circuits therebetween. Oppositely, sometimes some spaced specific contacts/wires should be grouped as one set by shorting together for meeting some required designed circumstances, that requires to intentionally short such contacts/wires together by soldering of the so-called jumper wires connected between every two of the selective contacts/wires. It also takes time and labor, and naturally costs money. Some U.S. patents disclose several different type shunt or jumper device incorporating some different type connectors for replacement of the complementary connectors during non-mating period of the subject connectors, for example, U.S. Pat. Nos. 4,602,834, 4,607,899, 4,997,390, 5,000,699, 5,391,096 and 5,609,493.

Therefore, an object of the invention is to provide a cable connector assembly having a bunch of wires connected thereof, wherein the contacts of the connector are connected to the corresponding wires through IDC means and a unitary shunting bar having piercing means thereon cooperating with the selective wires thereabouts, so that the contacts of connector can be electrically connected to the corresponding wires through such IDC means and some designated contacts can be short-circuiting with each other through such piercing means.

Moreover, it is desired that the insulation displacement shunting bar is correctly placed within the cable connector assembly, i.e., to prevent any disorientation, which otherwise might occur during manual assembly of the insulation displacement shunting bar.

SUMMARY OF THE INVENTION

According to an aspect of the invention, an electrical cable connector assembly includes an insulator defining a plurality of receiving slot therein for receiving a corresponding number of contacts therein wherein each contact has an IDC end for engagement with the corresponding wire. A shunt device includes a unitary body with fork-like piercing device thereon for engagement with the selective contacts. A pair of spacers are disposed on the upper and lower sides of the insulator to provide a plurality of troughs for receiving the corresponding wires therein. A pair of metal shields are attached to the exterior of the spacers. A pair of covers are respectively positioned on the exterior of the corresponding metal shells for protection and fastening the internal parts therein. A front shell and an associated attachment block are fastened to a front portion of the insulator for defining a mating end of the connector assembly. A strain relief is assembled to the rear end of the housing for preventing improper undesired impact upon connection between the wires and the corresponding contacts, due to pulling force applied on the cable.

According to another aspect of the invention, a method of preventing disorientation of an insulation displacement shunting bar with respect to a spacer in an electrical cable connector assembly is disclosed.

Also disclosed is a cable connector assembly utilizing an insulation displacement shunting bar which effectively prevents its disorientation in the cable connector assembly in an easy manner.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
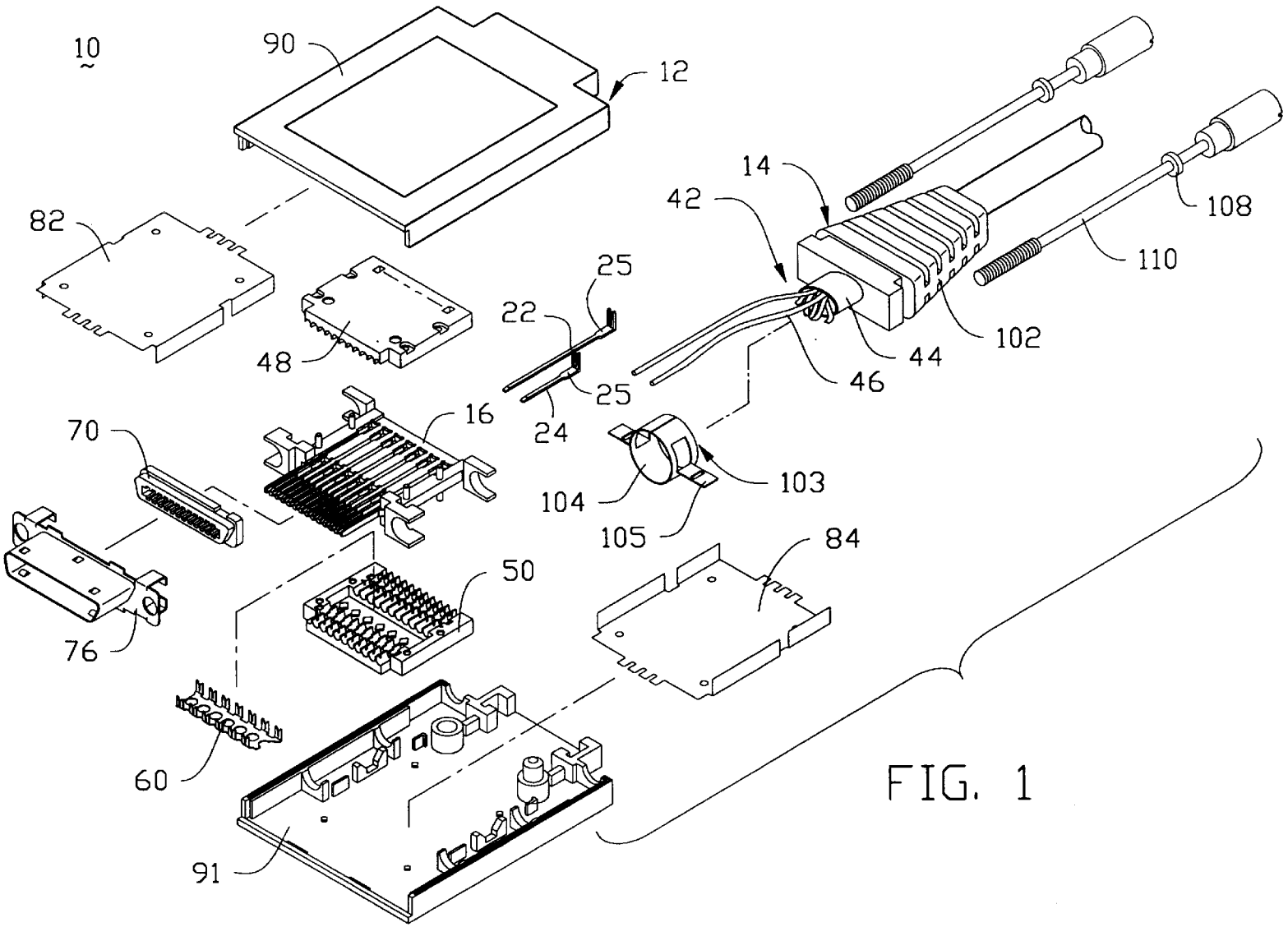
FIG. 1 is an exploded perspective view of a presently preferred embodiment of a cable connector assembly, according to the invention.
Figure 2:
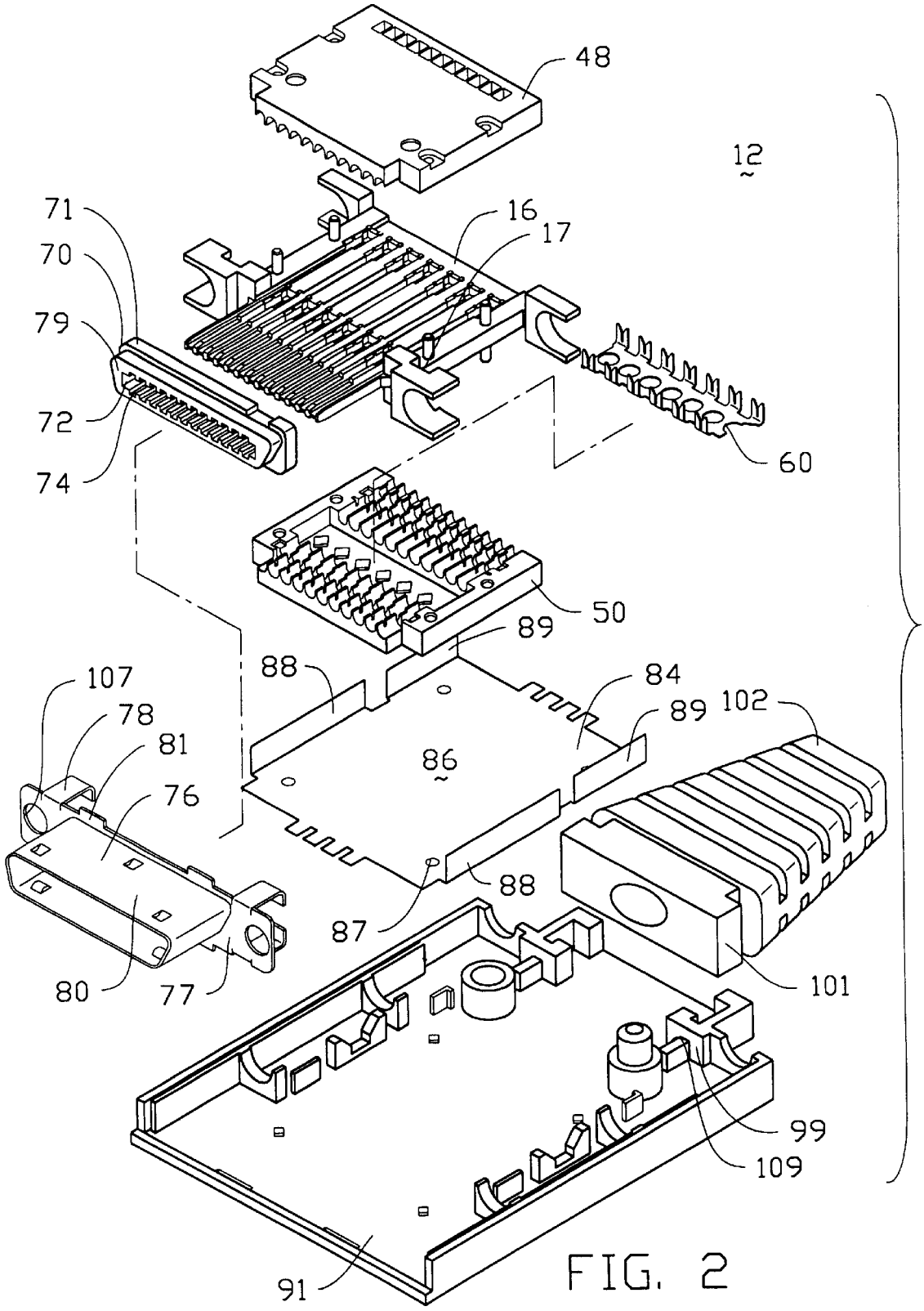
FIG. 2 is an enlarged exploded perspective view of the cable connector assembly of FIG. 1 without showing the top metal shield, the top cover, the securing ring, and the corresponding cable/wires, to show remaining components of the whole assembly for easy illustration.
Figure 4:
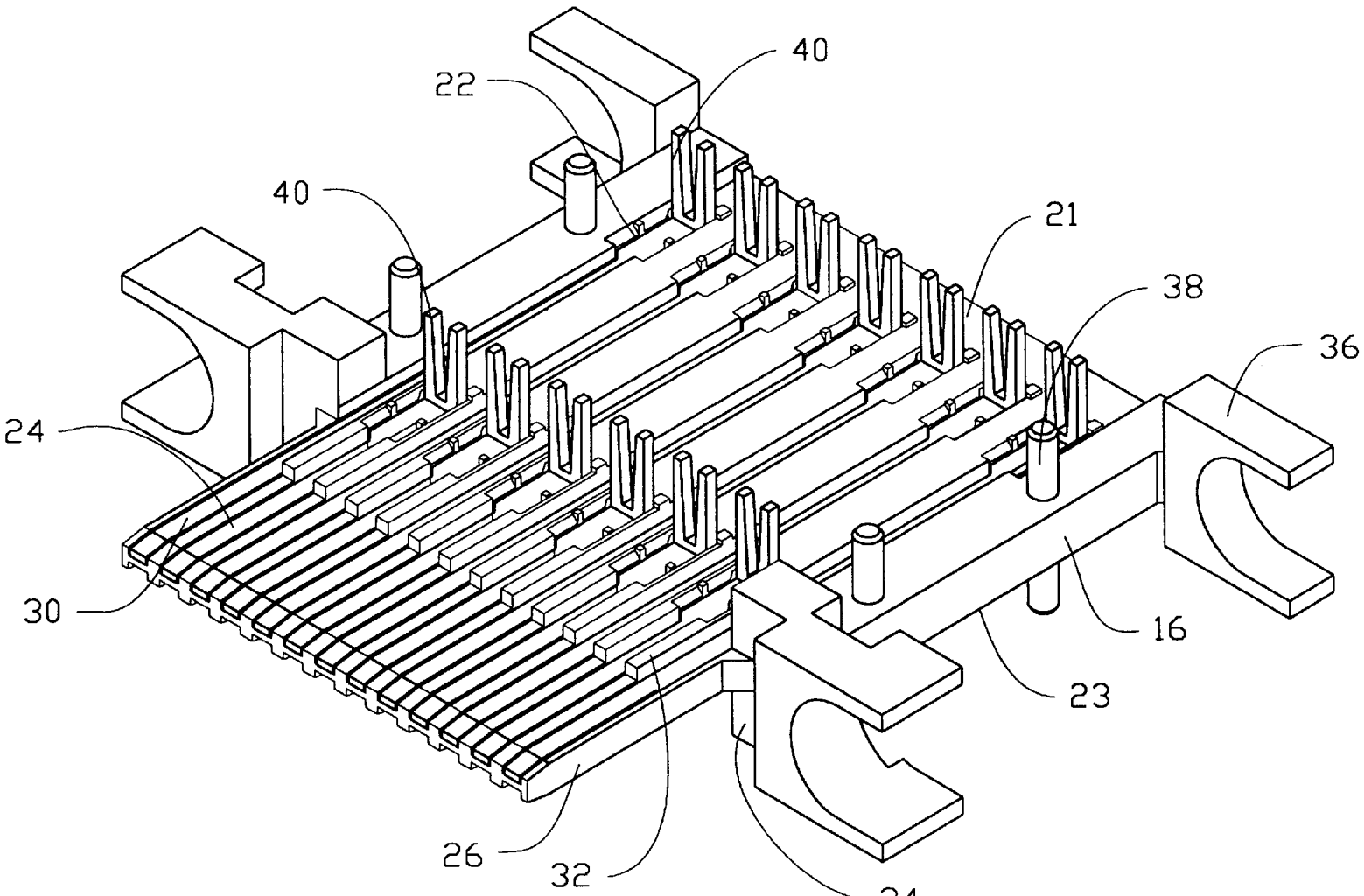
FIG. 4 is an enlarged perspective view of the partially assembled cable connector assemble of FIG. 1 to show how the contacts are disposed in the insulator.
Figure 5:
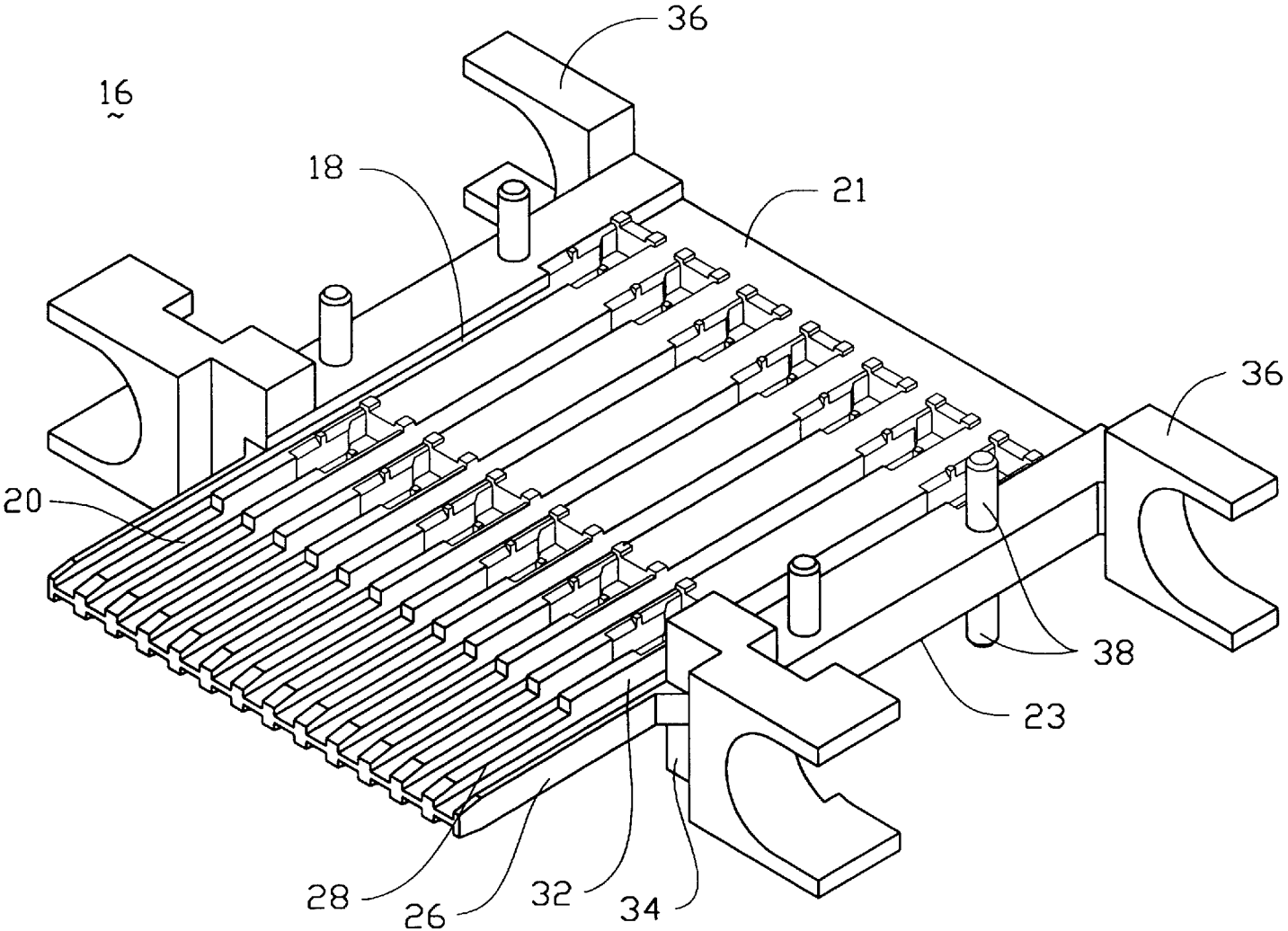
FIG. 5 is an enlarged perspective view of the insulator of the cable connector assembly of FIG. 1 to show the structure thereof.

It will be noted here that for a better understanding, most of like components are designated by like reference numerals throughout the various figures in the embodiments. Attention is directed to FIGS. 1 and 2 wherein an electrical cable/plug connector assembly 10 includes a connector section 12 and a cable section 14. The connector section 12 includes an insulator 16 (also referring to FIG. 5). defining a plurality of long passageways 18 and a plurality of short passageways 20 alternatively extending in a front-to-end direction on both the top surface 21 and the bottom surface 23 (only the ones of the top surface 21 shown). A corresponding number of long contacts 22 and another corresponding number of short contacts 24 are respectively received within the corresponding long and short passageways 18, 20. A blade section 26 is formed on the front portion of the insulator 16 wherein the front portions 28 of the passageways 18, 20 are positioned therein so that the engagement sections 30 (see FIG. 4) of the contacts 22, 24 are received within said front portions 28 of the passageways 18, 20. The blade section 26 further includes a plurality of parallel spaced engagement projections 32 on both the top and bottom surface 21, 23 for engagement with the corresponding notch 72 of the housing 70, that will be described later.

To receive the housing 70, the insulator 16 includes a recess 34 at the front end thereof. Moreover, to cooperate with two screws 110, two pairs of mounting ears 36 are provided on two sides thereof wherein each pair of mounting ears 36 are respectively positioned on two sides of the insulator 16. Two pairs of alignment posts 38 extending vertically on two sides of each of the top surface 21 and of the bottom surface 23 for incorporating the alignment holes 64 of the corresponding spacer 48, 50, that will be described later.

Each of the contacts 22, 24 has the engagement section 30 on the front portion and a termination section 40 on the end portion, wherein the engagement section 30 is adapted to be engaged with the corresponding contact section of the complementary receptacle connector (not shown), and the termination section 40 is adapted to be engaged with the corresponding wire 46 of the cable 42, that will be described later. Each of the contacts 22, 24 further includes a barb-like retention section 25 which can retain the contact 22, 24 in the corresponding passageways 18, 20 in an interference fit.

Figure 3:
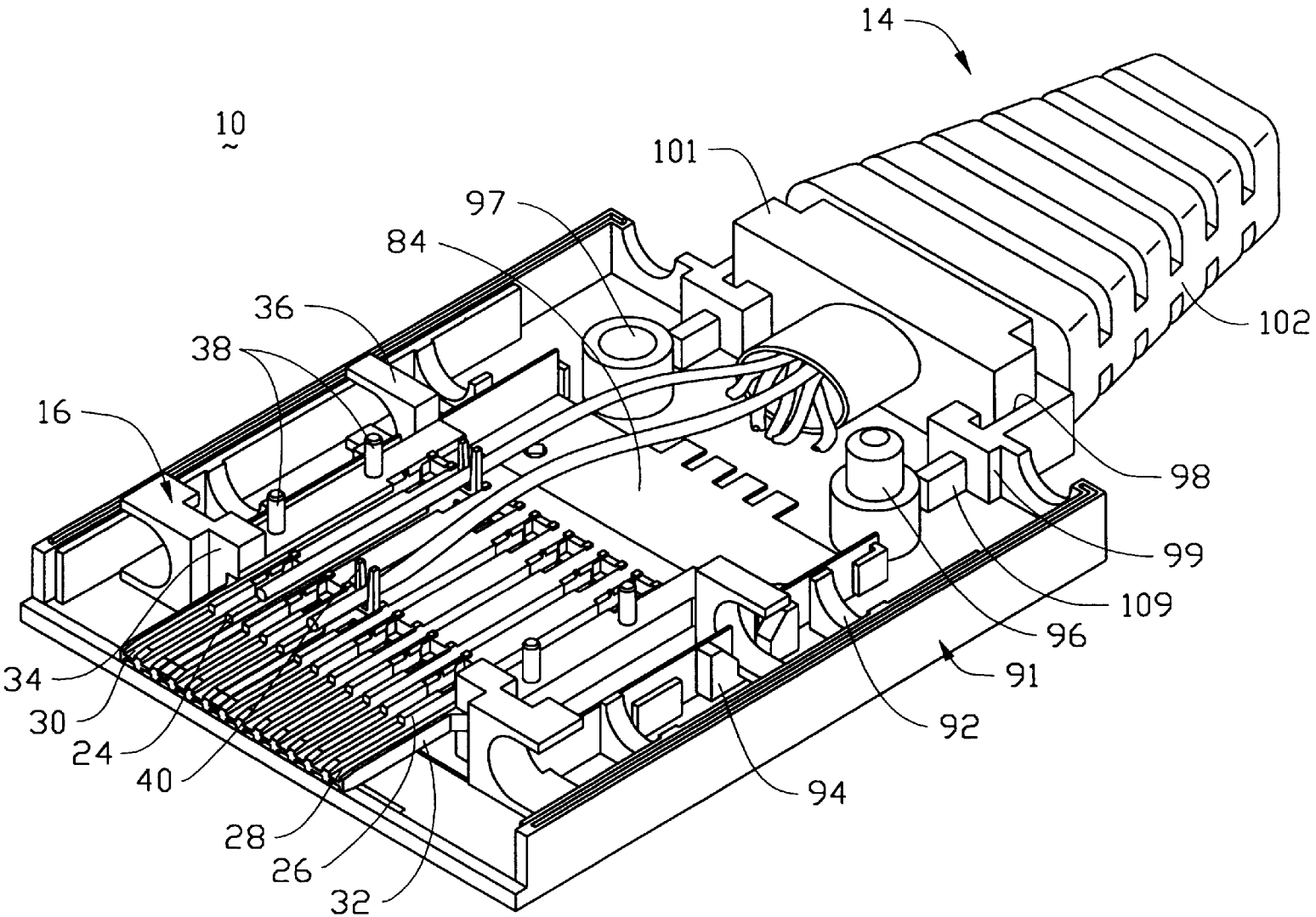
FIG. 3 is an enlarged perspective view of the partially assembled cable connector assembly of FIG. 1 to show how the interior parts embedded within the internal space defined between the top cover and the bottom cover.

The cable 42 includes a jacket 44 enclosing a plurality of wires 46 therein wherein each wire 46 is mechanically and electrically engaged with the termination section 40 of the corresponding contact 22, 24 via IDC connection. It should be understood that although FIGS. 1 and 3 only show two wires 46 cooperating with the corresponding long contact 22 and short contact 24 on the top surface 21 of the insulator 16, the remaining wires 46 and the corresponding contacts 22, 24 also have the same relationship with each other.

A top spacer 48 and a bottom spacer 50 are respectively disposed on the top surface 21 and the bottom surface 23 of the insulator 16 wherein each spacer 48, 50 includes a plurality of receiving troughs 52 corresponding to and in vertical alignment with the corresponding passageways 18, 20, whereby each wire 46 which is engageably pierced by the termination section 40 of the corresponding contact 22, (24) and is adapted to be received within the corresponding trough 52. Each of the spacer 48, 50 has a pair of elongated slit 54, 56 extending transversely on the front portion and the rear portion thereof for properly receiving the fork-like termination sections 40 of the contacts 22, 24.

One feature of the invention is that the spacer 50 further includes a cavity 51, and a shunting bar 60 is received therein. The shunting bar 60 includes a base plate 62 with mounting openings 64 therein for cooperation with the mounting posts 66 extending upward from the bottom cover 50 in the cavity 51 so that the shunting bar 60 can be retainably received within the cavity 51. The shunting bar 60 further includes a plurality of detachable fork-like piercing lances 68 for selectively mechanical and electrical engagement with the designated wires 46. In other words, some piercing lances 68 of the shunting bar 60 can be detached from the base plate 62 thereof for not mechanical and electrical engagement with the wires, while the remaining piercing lances 68 may interconnect with the corresponding designated wires 46, respectively, in an IDC state, thereby resulting in shorting-circuit function of such designated wires 46.

To align the spacer 48, 50 with the insulator 16 during assembling, the spacer 48, 50 includes alignment holes 64 for receivable engagement with the alignment posts 38 of the insulator 16.

Figure 9:
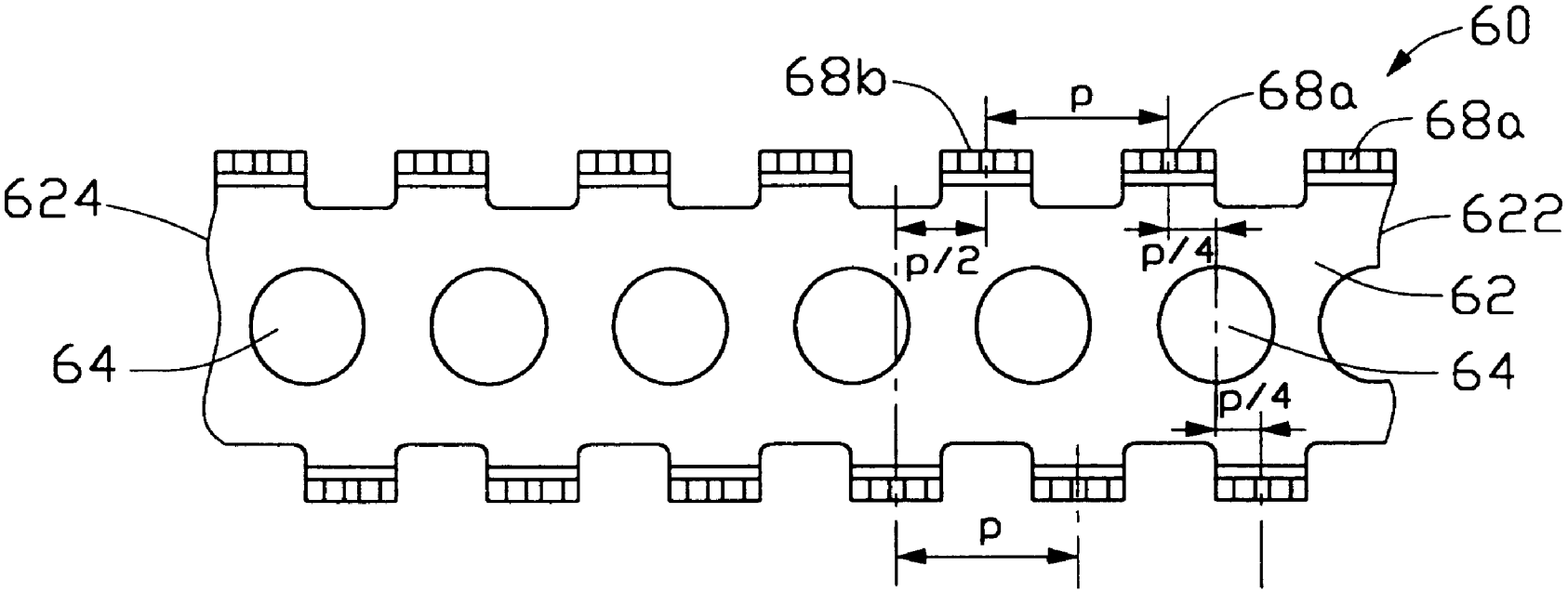
FIG. 9 is an enlarged plan view of the shunting bar of the second embodiment according to the invention.
Figure 10:
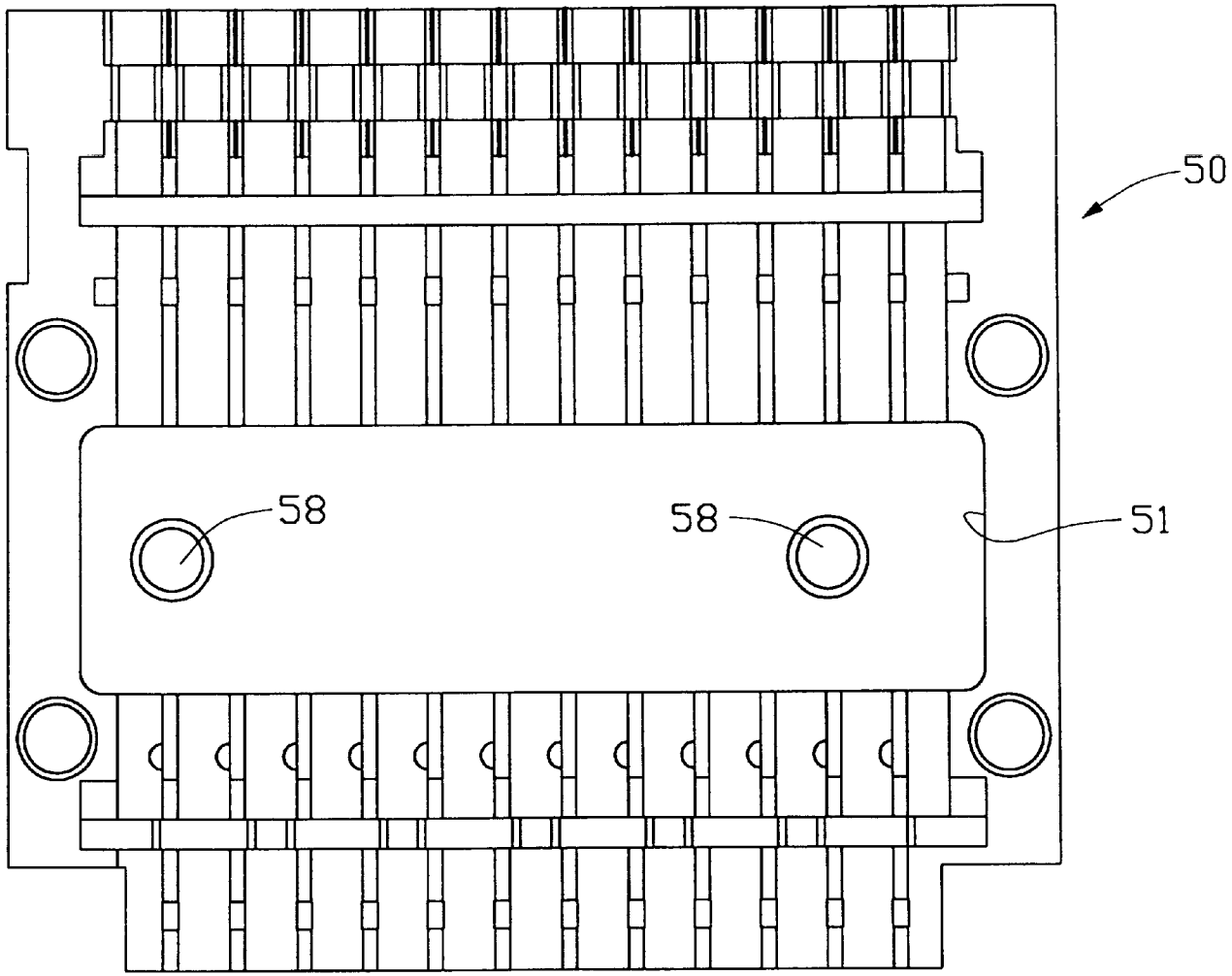
FIG. 10 is an enlarged plan view of the bottom spacer of the cable connector assembly of a second embodiment corresponding to the shunting bar of FIG. 9.
Figure 11:
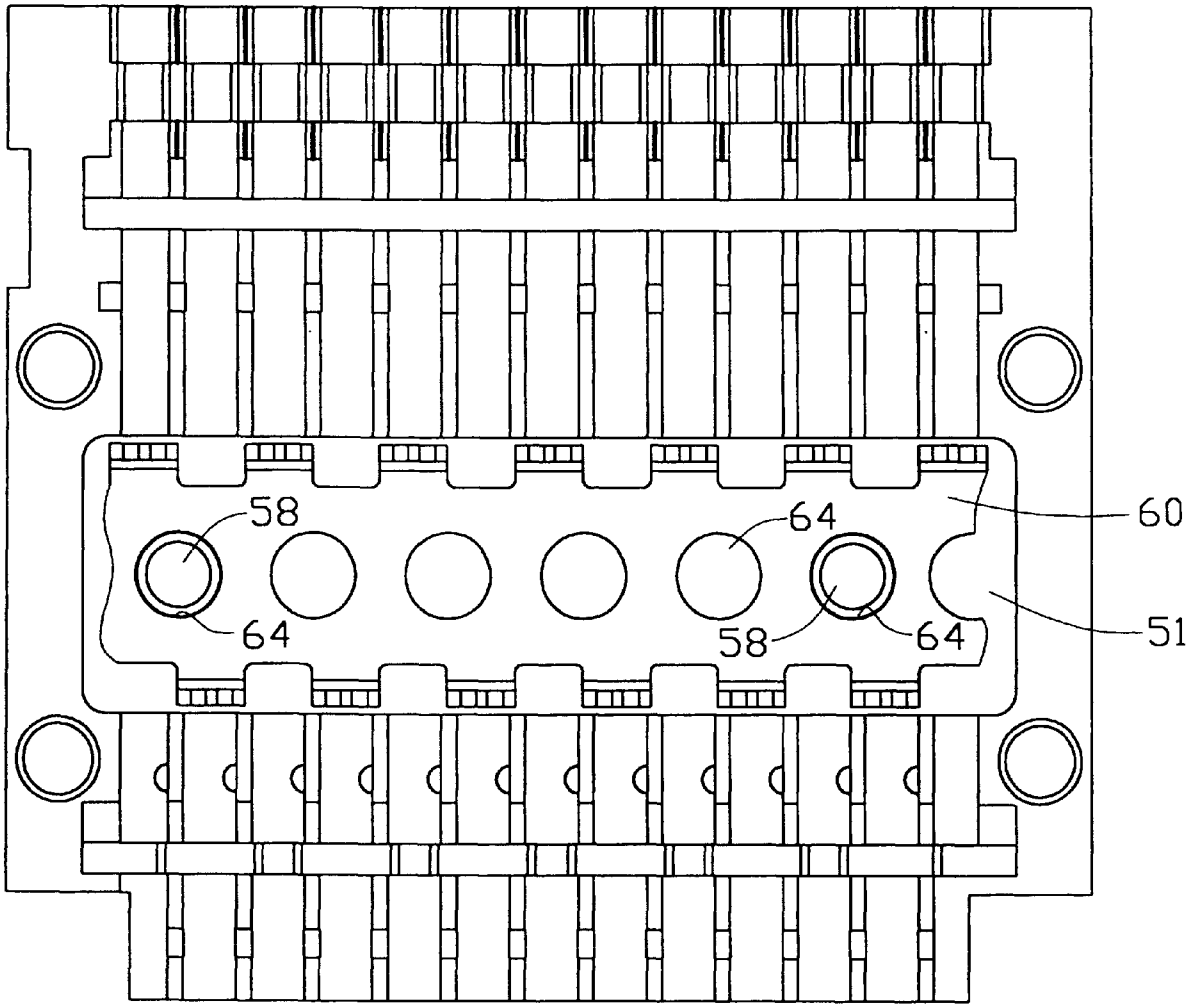
FIG. 11 is an assembled plan view of the shunting bar of FIG. 9 and the bottom spacer of the cable connector assembly of FIG. 10.

It is noted that properly placement or orientation of the insulation displacement shunting bar 60 within the cavity 51 of the spacer 50 is important to insure that the insulation displacement shunting bar 60 may perform its intended purpose. As shown in FIGS. 9–11, the shunting bar 60 has a base plate 62 defining a first end 622 and a second end 624 and has a plurality of piercing lances 68 equally spaced along each of two longitudinal opposite sides of the base plate, as previously described. Adjacent two piercing lances on one side of the base plate 62, for example 68*a* and 68*b*, are distanced a given pitch p from each other and adjacent two piercing lances on the other side of the base plate 62 are also distanced the same given pitch p from each other and further offsetting a half of the pitch p/2 along a length of the base plate 62. The cavity 51 of the spacer 50 has a length slightly larger than a general length of the shunting bar 60. Moreover, the plurality of mounting openings 64 on the base plate 62 of the shunting bar 60 are equally spaced along a length thereof. The mounting openings 64 are offset substantially one-fourth of the pitch p/4, as measured along the length of the base plate 62, with respect to the piercing lances 68 on either one of the two sides of the base plate 62. In this arrangement, a first distance defined between the first end 622 of the base plate 62 and the mounting opening 64 nearest to the first end 622 of the base plate 62 is unequal in dimension to a second distance defined between the second end 624 of the base plate 62 and the mounting opening 64 nearest to the second end 624 of the base plate 62.

Figure 8:
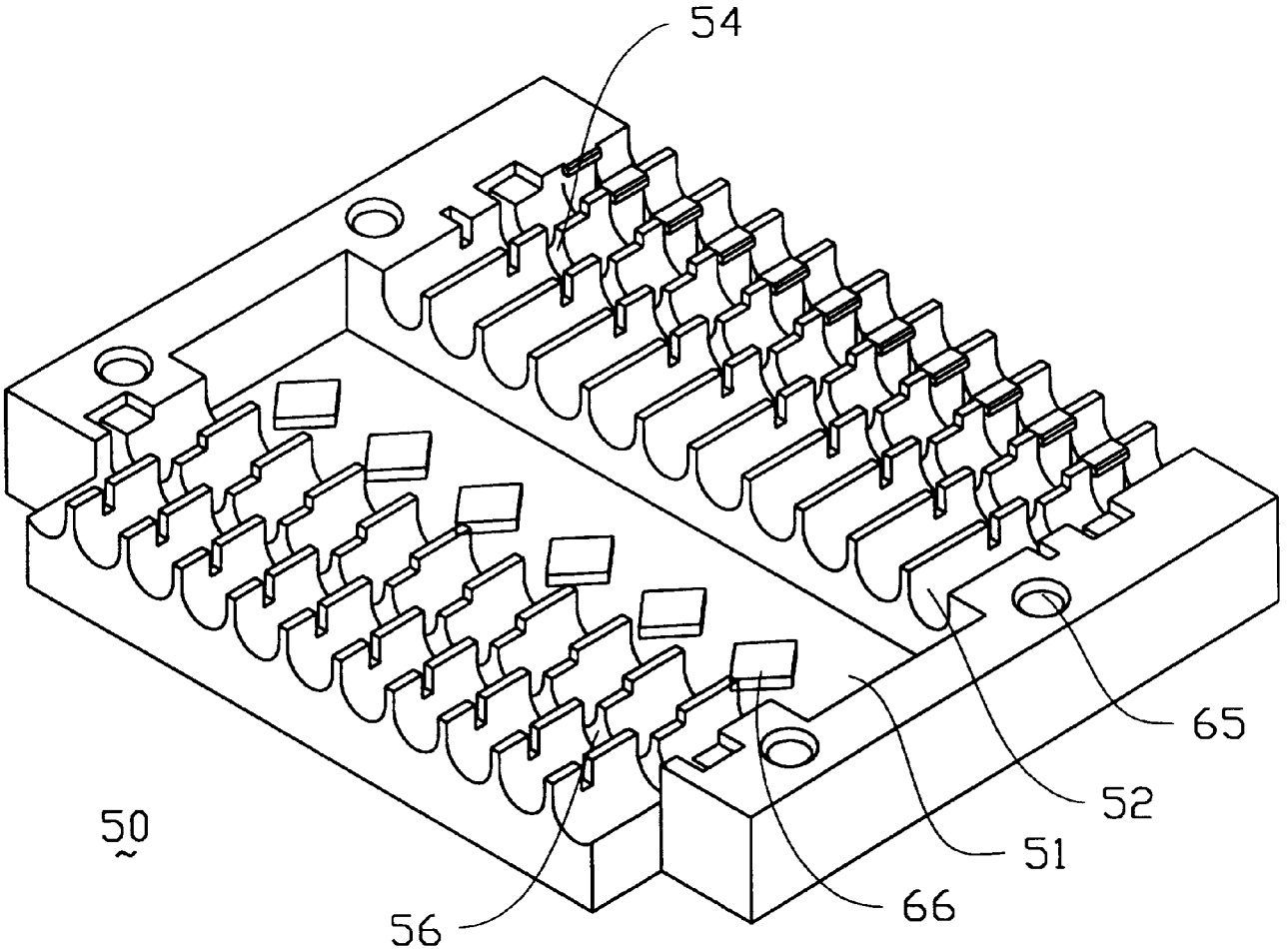
FIG. 8 is an enlarged perspective view of the bottom spacer of the cable connector assembly of FIG. 1.

As FIG. 10 shows, the cavity 51 of the spacer 50 has two circular mounting posts 58, in contrast to six rectangular ones shown in the embodiment of FIG. 8, aligned with two of the plurality of mounting openings 64, namely the mounting openings 64 nearest to the first and second ends 622 and 624 of the base plate 62 for the embodiment shown in FIG. 9. It is understood that these two mounting posts 58 correspond to the two farthest mounting openings 64 of the base plate 62.

It is noted that in the above arrangement, corresponding to offsetting of the mounting openings 64 with respect to the piercing lances 68, the two mounting posts 58 are disposed to be aligned with two of the plurality of mounting openings 64 when the shunting bar 60 is in a first orientation with respect to the cavity of the spacer (as shown in FIG. 11) and to be misaligned with the two mounting openings 64 when the shunting bar is in a second orientation which is rotated 180 degrees on a general plane of the shunting bar 60 relative to the first orientation as might occur during manual placement of the shunting bar 60 within the cavity 51 of the spacer 50.

It can be understood that generally for the shunting bar 60 made from the standard contact strip, the mounting openings 64 are generally disposed spaced from one another with a distance of pitch P between every two adjacent mounting openings 64 thereof. (The reason why pitch P is set between every two adjacent mounting openings 64, is to comply with that between the adjacent two piercing lances 68 to have the whole contact strip in a uniform configuration with convenience to cut down the shunting bar 60 with the predetermined length thereof piece by piece, wherein each shunting bar 60 is guaranteed to be same with each other during mass production, including the same number of mounting openings 64 and of the piercing lances 68 with the same relative positions thereof.) Also, as mentioned before, the adjacent two piercing lances 68 on either side of the base plate 62 are distanced a given pitch P from each other. Therefore, if the mounting openings 64 are designedly aligned with the corresponding piercing lances 68 in a transverse direction, i.e., the front-to-back direction, regardless of the upper side piercing lances or the lower side piercing lances, such mounting openings 64 will, similar to the piercing lances 58, be substantially in a symmetric manner along the length of the base plate 62 of the shunting bar 60. Under this situation, it is easy for the operator to mistakenly assemble the shunting bar 60 into the cavity 51 of the spacer 50 with an incorrect orientation thereto. The second embodiment of the invention intentionally provides the series of mounting openings 64 offset from the piercing lances 68 so as to form an asymmetric arrangement of the mounting openings 64 along the base plate 62 of the shunting bar 60 for anti-misorientation of the shunting bar 60 with regard to the spacer 50. Correspondingly, the mounting posts 58 are also provided within the cavity 51 with an asymmetric manner so as to assure the correct installation of the shunting bar 60 to the spacer 50 all the time.

The housing 70 is assembled to the insulator 16 by means that the housing 70 is generally received within the recess 34 of the insulator 16, whereby the engagement projections 32 of the insulator 16 may be receivably engaged within the notches 72 of the housing 70, respectively. At the same time, each of the abutment projections 74, formed between every adjacent two notches 72, of the housing 70 may press against the corresponding contact 22, 24 for providing an additional retention other than the barb-like retention section 25 of the contact 22, 24.

A shell 76 is fastened to the insulator 16 by means that the hooks 78 are retainable engaged within the indents 17 of the insulator 16, whereby the housing 70 may be sandwiched between the shell 76 and the insulator 16 and securely received within the recess 34 in the insulator 16 through abutment between the vertical plate 71 of the housing 70 and the vertical plate 77 of the shell 76. Under this situation, the D-shaped forward extension 79 of the housing 70 can be snugly received within the D-shaped opening 80 of the shell 76. Naturally, the blade section 26 of the insulator 16 also projects forward within such D-shaped opening 80 of the shell 76.

A top shield 82 and a bottom shield 84 are respectively disposed on the top and the bottom of the pre-assembled or semi-finished assembly consisting essentially of the insulator 16, the contacts 22, 24, the wires 46 of the cable 42, the top spacer 48 and the bottom spacer 50. Each shield 82, 84 has a base plate 86 with two pairs of side abutment walls 87, 88 respectively positioned on the front portion and the rear portion thereof wherein there is a lateral offset between the front pair of side abutment walls 87 and the rear pair of side abutment walls 88. Therefore, when the top shield 82 and the bottom shield 84 are attached to the top and the bottom of the semi-finished assembly, the front pair of abutment walls 87 of the top shield 82 and those of the bottom shield 84 will be overlapped with each other in a lateral direction; similarly, the rear pair of abutment walls 88 of the top shield 82 and those of the bottom shield 84 will operate with each other in the same manner. Thus, through cooperation of the front pairs of abutment walls 87 of the shields 82, 84 and the rear pairs of abutment walls 88 of the shields 82, 84, the shields 82 and 84 can be secured with each other in an abutment state without lateral and lengthwise movement.

Figure 6:
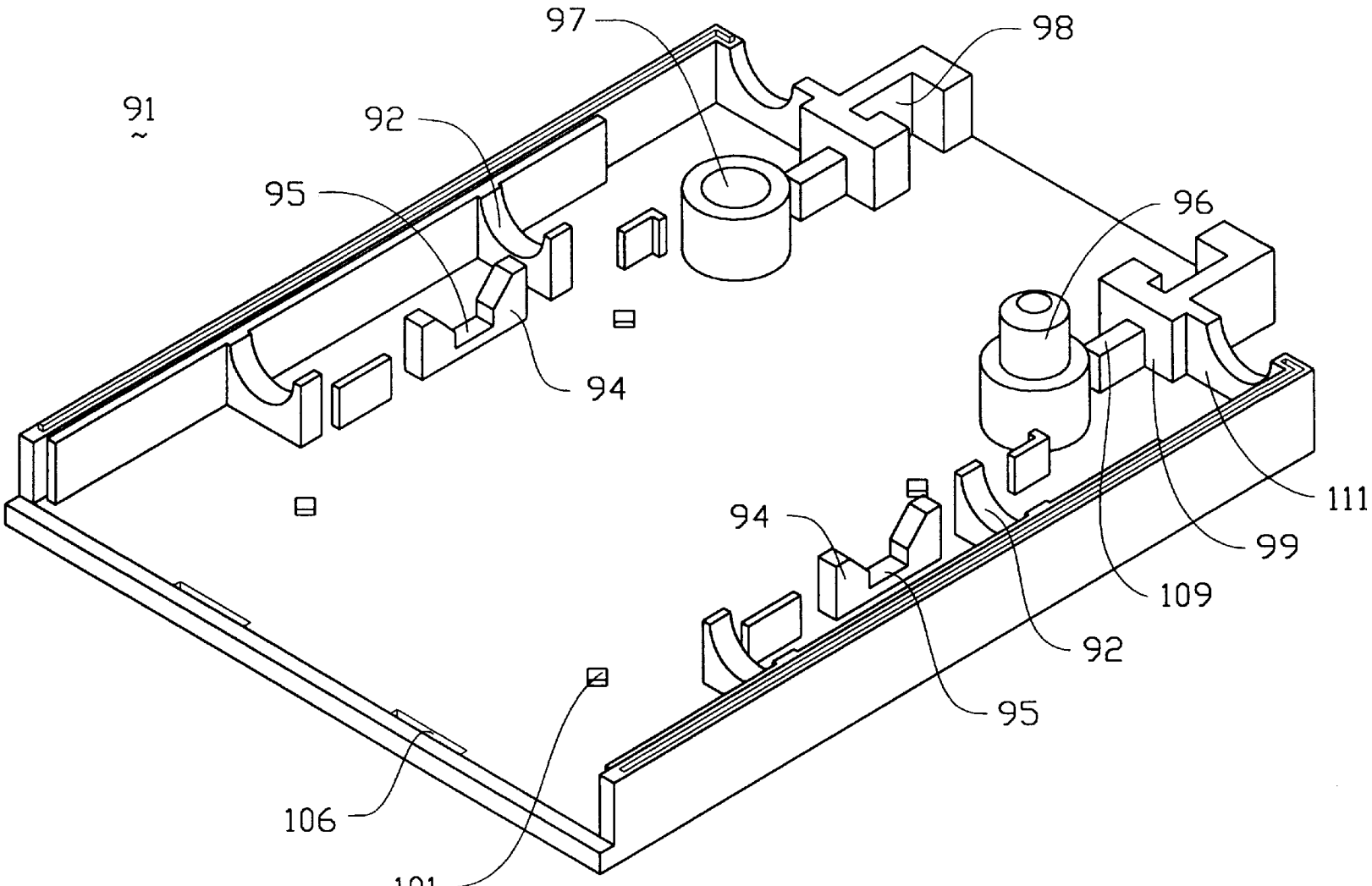
FIG. 6 is an enlarged perspective view of the bottom cover of the cable connector assembly of FIG. 1.
Figure 7:
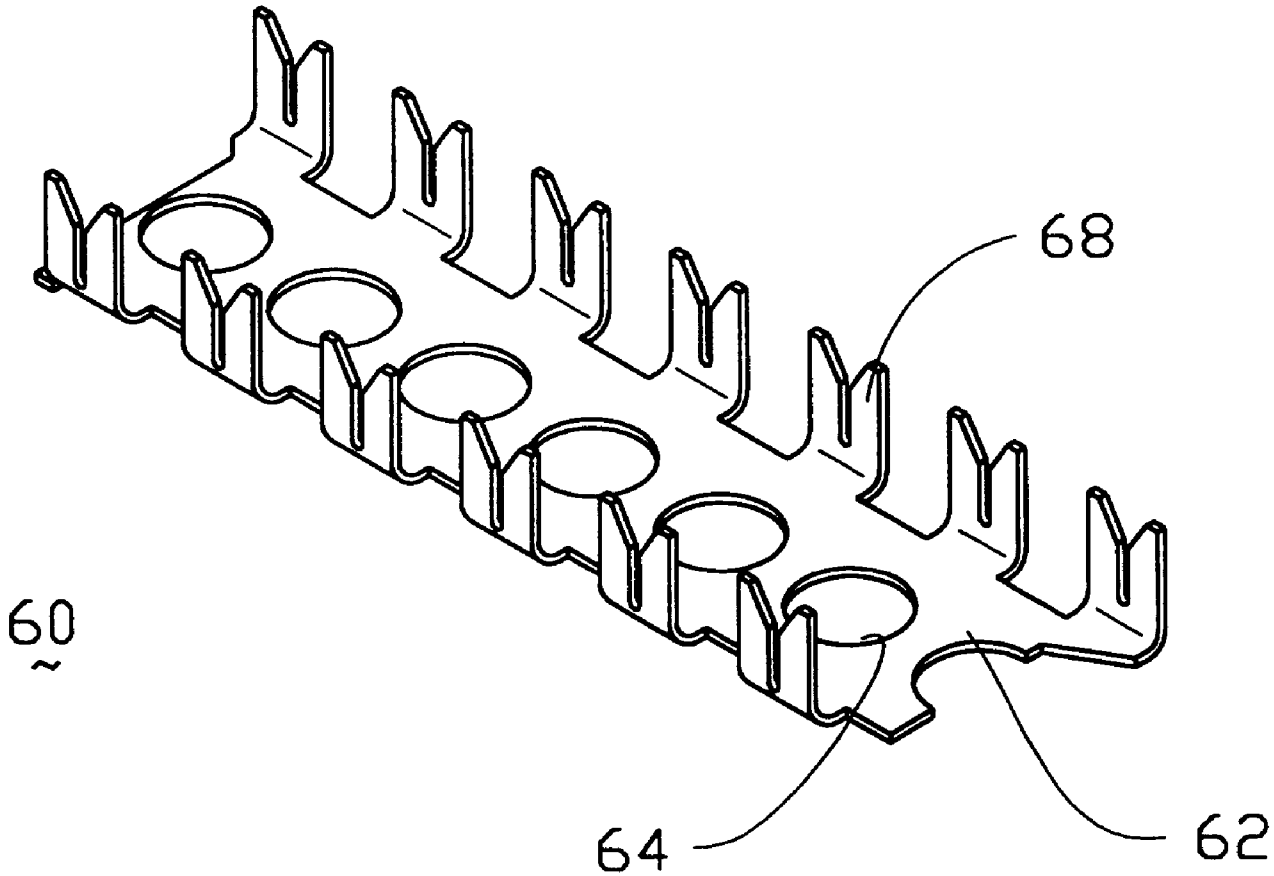
FIG. 7 is an enlarged perspective view of the shunting bar of the cable connector assembly of FIG. 1.

Finally, a top cover 90 and a bottom cover 91 are attached to the aforementioned sub-combination of the final assembly. referring to FIG. 6, each cover 90, 91 includes a pair of semi-circle channels 92 on two sides for allowing a pair of screws 100 to receivably extend therethrough. A pair of mounting blocks 94 each defining a groove 95 therein for cooperatively receiving the rear mounting ears 36 of the insulator 16 so that the insulator 16 of each sub-combination can be retained within the covers 90, 91 without lengthwise movement. Each cover 90, 91 further includes mounting posts 100 extending inwardly for cooperatively receipt within the corresponding mounting apertures 87 in the shields 82, 84, thereby the sub-combination of the final assembly can be retained within the covers 90, 91 without horizontal movement.

Each cover 90 (91) further includes an alignment post 96 and an alignment receiving cylinder 97 for mutually cooperation with the receiving cylinder 97 and the post 96 of the counterpart cover 91 (90) so that the top cover 90 and the bottom cover 91 can be aligned with each other when assembled. A receiving shroud section 98 is formed on the rear portion of each cover 90, 91 for receiving therein an enlarged head 101 of a strain relief 102 through which the cable 42 extends. A stopper wall 99 is formed in front of the shroud section 98 of each cover 90, 91. A clip 103, includes a ring portion 104 for binding the exit of the cable 42, and a pair of wings 105 for supportably embedded within the recessions 109 adjacent the stopper wall 99 and confront the corresponding stopper walls 99 so as to resist the rearward pull force applied to the external cable, thus functioning as auxiliary strain relief.

The cover 90, 91 further includes retention indention 106 on the interior surface of the front portion for latchably receiving the locating projections 81 of the shell 76, thus resulting in additional retention of the sub-combination of the final assembly with regard to the covers 90, 91.

After the top cover 90 and the bottom cover 91 precisely and fully enclose the sub-combination of the final assembly, the top cover 90 and the bottom cover 91 can be secured to each other by ultrasonic welding along the edges thereof. Therefore, the whole final assembly is in a hermetic manner. Under this situation, the screws 110 have been installed within the covers 90, 91 and extends out of the screw holes 107 of the shell 76 for being adapted to latchably engage the complementary receptacle connector (not shown), wherein the stopper ring 108 of each screw can rest against the rear wall 111 of the cover 90, 91 for preventing rearward withdrawal of the screw 110 from the cover 90, 91 of the final assembly.

The assembling method and the corresponding structure of the invention is somewhat similar to and can be referred to the copending application Ser. No. 08/748,101 for easy understanding.

While the present invention has been described with reference to specific embodiments, the description is illustrative of the invention and is not to be construed as limiting the invention. Various modifications to the present invention can be made to the preferred embodiment by those skilled in the art without departing from the true spirit and scope of the invention as defined by the appended claims.

Therefore, person of ordinary skill in this field are to understand that all such equivalent structures are to be included within the scope of the following claims.

What is claimed is:

1. A method of preventing disorientation of an insulation displacement shunting bar with respect to a spacer in an electrical cable connector assembly, the shunting bar having a base plate defining a first end and a second end and having a plurality of piercing lances equally spaced along each of two longitudinal opposite sides of the base plate, adjacent two piercing lances on one side of the base plate being distanced a given pitch from each other and adjacent two piercing lances on another opposite side of the base plate being distanced the same given pitch from each other and further offsetting a half of the pitch along a length of the base plate, and the spacer having a cavity for accommodating the base plate of the shunting bar, the cavity of the spacer having a length slightly larger than a length of the shunting bar, the method comprising the steps of:

disposing a plurality of mounting openings equally spaced lengthwise on the base plate which are offset substantially one-fourth of the pitch, as measured along the length of the base plate, with respect to the piercing lances on one of the two sides of the base plate to create a first distance between the first end of the base plate and the mounting opening nearest to the first end of the base plate and a second distance between the second end of the base plate and the mounting opening nearest to the second end of the base plate which is unequal to the first distance; and forming at least two mounting posts within the cavity of the spacer at positions aligned with two of the plurality of mounting openings.

2. The method as claimed in claim 1, wherein the at least two mounting posts comprise two mounting posts which are disposed to correspond to two farthest mounting openings of the base plate.

3. The method as claimed in claim 1, wherein there are six mounting posts formed within the cavity of the spacer.

4. A method of preventing disorientation of an insulation displacement shunting bar with respect to a spacer in an electrical cable connector assembly, the shunting bar having a base plate defining a first end and a second end and having a plurality of piercing lances equally spaced along each of two longitudinal opposite sides of the base plate, adjacent two piercing lances on one side of the base plate being distanced a given pitch from each other and adjacent two piercing lances on another opposite side of the base plate being distanced the same given pitch from each other and further offsetting a half of the pitch along a length of the base plate, and the spacer having a cavity for accommodating the base plate of the shunting bar, the cavity of the spacer having a length slightly larger than a general length of the shunting bar, the method comprising the steps of:

disposing a plurality of mounting openings equally spaced lengthwise on the base plate of the shunting bar which are offset substantially one-fourth of the pitch, as measured along the length of the base plate, with respect to the piercing lances on one of the two sides of the base plate; and forming at least two mounting posts within the cavity of the spacer to align with two of the plurality of mounting openings when the shunting bar is in a first orientation with respect to the cavity of the spacer and to misalign with the two mounting openings when the shunting bar is in a second orientation which is rotated 180 degrees on a general plane of the shunting bar relative to the first orientation.

5. The method as claimed in claim 4, wherein the at least two mounting posts comprise two mounting posts which are disposed to correspond to two farthest mounting openings of the base plate.

6. The method as claimed in claim 4, wherein there are six mounting posts formed within the cavity of the spacer.

7. A cable connector assembly comprising a cable having a plurality of wires and a connector having a housing, an insulator mounted to the housing, a plurality of contacts mounted to the insulator, a spacer mounted to the insulator and having a cavity facing the insulator, and a shunting bar disposed within the cavity of the spacer, the shunting bar having a base plate and a plurality of piercing lances equally spaced along each of two longitudinal opposite sides of the base plate, adjacent two piercing lances on one side of the base plate being distanced a given pitch from each other and adjacent two piercing lances on another opposite side of the base plate being distanced the same given pitch from each other and further offsetting a half of the pitch along a length of the base plate, the cavity of the spacer having a length slightly larger than a length of the shunting bar, wherein the improvement comprises:

the base plate of the shunting bar having a plurality of mounting openings equally spaced along a length thereof, the mounting openings being offset substantially one-fourth of the pitch, as measured along the length of the base plate, with respect to the piercing lances on one of the two sides of the base plate, a first distance defined between the first end of the base plate and the mounting opening nearest to the first end of the base plate being unequal to a second distance defined between the second end of the base plate and the mounting opening nearest to the second end of the base plate; and the cavity of the spacer having at least two mounting posts aligned with two of the plurality of mounting openings.

8. The cable connector assembly as claimed in claim 7, wherein the at least two mounting posts comprise two mounting posts which are disposed to correspond to two farthest mounting openings of the base plate.

9. The cable connector assembly as claimed in claim 7, wherein there are six mounting posts formed within the cavity of the spacer.

10. A cable connector assembly comprising a cable having a plurality of wires and a connector having a housing, an insulator mounted to the housing, a plurality of contacts mounted to the insulator, a spacer mounted to the insulator and having a cavity facing the insulator, and a shunting bar disposed within the cavity of the spacer, the shunting bar having a base plate and a plurality of piercing lances equally spaced along each of two longitudinal opposite sides of the base plate, adjacent two piercing lances on one side of the base plate being distanced a given pitch from each other and adjacent two piercing lances on another opposite side of the base plate being distanced the same given pitch from each other and further offsetting a half of the pitch along a length of the base plate, the cavity of the spacer having a length slightly larger than a length of the shunting bar, wherein the improvement comprises:

the base plate of the shunting bar having a plurality of mounting openings equal spaced along a length thereof, the mounting openings being offset substantially one-fourth of the pitch, as measured along the length of the base plate, with respect to the piercing lances on one of the two sides of the base plate; and the cavity of the spacer having at least two mounting posts, the at least two mounting posts being aligned with two of the plurality of mounting openings when the shunting bar is in a first orientation with respect to the cavity of the spacer and being misaligned with the two mounting openings when the shunting bar is in a second orientation which is rotated 180 degrees on a general plane of the shunting bar relative to the first orientation.

11. The cable connector assembly as claimed in claim 10, wherein the at least two mounting posts comprise two mounting posts which are disposed to correspond to two farthest mounting openings of the base plate.

12. The cable connector assembly as claimed in claim 10, wherein there are six mounting posts formed within the cavity of the spacer.

13. An arrangement of anti-misorientation between a first device made from a contact strip, and a second device adapted to receive said first device therein, comprising:

a base plate formed with the first device, said base plate defining a first end and a second end and including a plurality of contact sections side by side spaced from each other along a lengthwise direction thereof with a first pitch, and a plurality of mounting openings side by side spaced from each other along the lengthwise direction with a second pitch; and the mounting openings being respectively offset from the corresponding contact sections to have said mounting openings and the corresponding contact sections not aligned with each other in a transverse direction, whereby said contact sections are symmetric with regard to the first end and the second end of the base plate while said mounting openings are asymmetric with regard to the first end and the second end of the base plate.

14. The arrangement as claimed in claim 13, wherein said second device includes a cavity for receiving said first device therein, and at least a mounting post asymmetrically positioned within the cavity for reception within the corresponding mounting opening which is asymmetrically positioned in the first device.

15. The arrangement as claimed in claim 13, wherein the first pitch is equal to the second pitch.

16. The arrangement as claimed in claim 13, wherein the mounting opening and the corresponding contact section are offset with each other with a distance of one fourth of the first pitch.

* * * * *